US005564393A

United States Patent [19]

Asano et al.

[11] Patent Number: 5,564,393

[45] Date of Patent: Oct. 15, 1996

[54] FUEL CONTROL METHOD FOR INTERNAL COMBUSTION ENGINE AND SYSTEM THEREOF

[75] Inventors: Seiji Asano; Mamoru Nemoto, both of Katsuta, Japan

[73] Assignees: Hitachi, Ltd.; Hitachi Automotive Engineering Co., Ltd., both of Japan

[21] Appl. No.: 583,957

[22] Filed: Jan. 11, 1996

Related U.S. Application Data

[63] Continuation of Ser. No. 243,166, May 16, 1994, abandoned.

[30] Foreign Application Priority Data

May 14, 1993 [JP] Japan ..... 5-112697

[51] Int. Cl.[6] ..... F02D 41/18

[52] U.S. Cl. ..... 123/492

[58] Field of Search ..... 123/478, 480, 123/486, 492, 493

[56] References Cited

U.S. PATENT DOCUMENTS

| | | | |
|---|---|---|---|
| 4,987,890 | 1/1991 | Nagaishi | 123/492 |
| 5,134,981 | 8/1992 | Takahashi et al. | 123/492 |
| 5,134,983 | 8/1992 | Kusunoki et al. | 123/492 |
| 5,215,061 | 6/1993 | Ogawa et al. | 123/492 |
| 5,261,370 | 11/1993 | Ogawa et al. | 123/492 |
| 5,383,126 | 1/1995 | Ogawa et al. | 123/492 |

FOREIGN PATENT DOCUMENTS

| | | |
|---|---|---|
| 62-48053 | 10/1987 | Japan . |
| 3-59255 | 9/1991 | Japan . |

*Primary Examiner*—Willis R. Wolfe

*Attorney, Agent, or Firm*—Evenson, McKeown, Edwards & Lenahan P.L.L.C.

[57] ABSTRACT

A method and apparatus for controlling the fuel injection rate of an internal combustion engine in which the formation of a fuel liquid film on interior walls of the fuel intake manifold is compensated by detecting the intake air flow rate to the internal combustion engine, and using it to access a fuel condensation rate table and a fuel evaporation rate table.

20 Claims, 11 Drawing Sheets

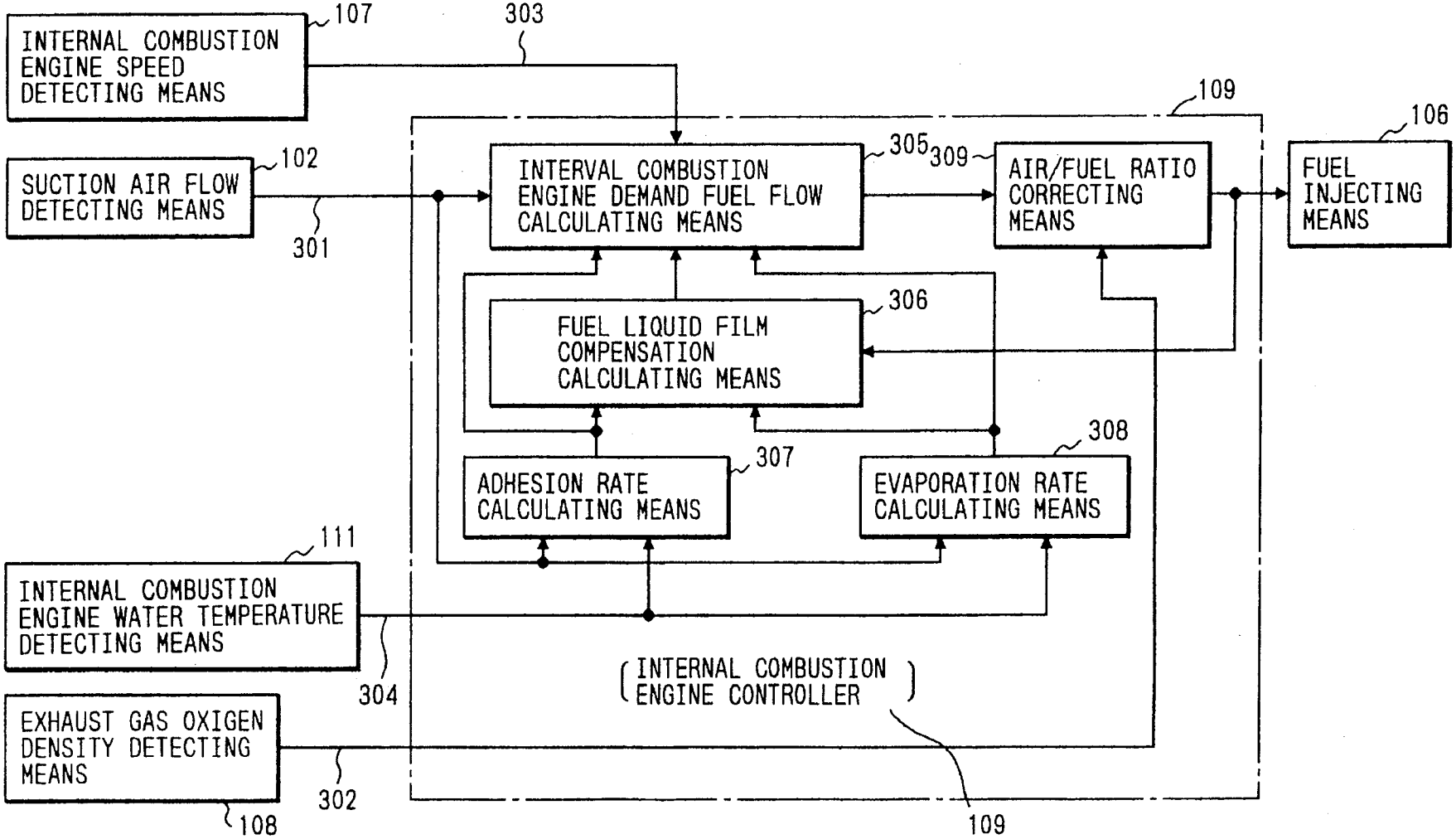
FIG. 3
FUEL INJECTING MEANS
106
109
AIR/FUEL RATIO CORRECTING MEANS
309
305
INTERVAL COMBUSTION ENGINE DEMAND FUEL FLOW CALCULATING MEANS
306
FUEL LIQUID FILM COMPENSATION CALCULATING MEANS
308
EVAPORATION RATE CALCULATING MEANS
307
ADHESION RATE CALCULATING MEANS
(INTERNAL COMBUSTION ENGINE CONTROLLER)
109
303
107
INTERNAL COMBUSTION ENGINE SPEED DETECTING MEANS
102
SUCTION AIR FLOW DETECTING MEANS
301
111
INTERNAL COMBUSTION ENGINE WATER TEMPERATURE DETECTING MEANS
304
302
EXHAUST GAS OXIGEN DENSITY DETECTING MEANS
108

FUEL CONTROL METHOD FOR INTERNAL COMBUSTION ENGINE AND SYSTEM THEREOF

This application is a continuation of application Ser. No. 08/243,166, filed on May 16, 1994, abandoned.

BACKGROUND OF THE INVENTION

1. Field of the Invention

The present invention relates to a fuel control method and apparatus for an internal combustion engine and, more particularly, to control method and a fuel apparatus which achieves increased accuracy by taking into account the effect of condensation of fuel on the internal walls of the fuel intake flow passage.

2. Description of the Prior Art

In fuel control systems for internal combustion engines, the accumulation of a fuel film on the internal surfaces of the fuel intake passages due to condensation introduces a source of error which causes inaccuracy in fuel control. That is, the condensation of fuel, which adheres or attaches to the walls of such flow passages, causes the actual rate of fuel intake to differ from the fuel injection rate at the fuel injectors. Several prior art technologies have been developed to compensate for this difference, such as the following.

Japanese Patent Publication No. 62-48053 (1987) discloses a compensation arrangement comprising a device for calculating a value for the current equilibrium intake surface fuel (that is, the amount of fuel contained in the fuel film which adheres to the walls of the fuel passages) as a function of engine operating parameters, a device for calculating a current intake surface fuel time constant as a function of engine operating parameters, a device for calculating current actual intake surface fuel as a first order differential function of the previous actual intake surface fuel and a transition rate of the previous actual intake surface fuel, and a device for calculating the current transition rate of intake surface fuel as a function of the current equilibrium current intake surface fuel, the intake surface time constant and the current actual intake surface fuel, and iteratively calculates the transition rate of intake surface fuel to determine a fuel demand in conjunction with a required fuel flow rate. In the Detailed Description of the Invention in the Japanese Patent Publication, there is this following description, "an abrupt acceleration causes an increase in the rate of fuel accumulation on the wall of the intake flow passage and an abrupt deceleration causes a decrease in the rate of fuel accumulation on the wall of the intake flow passage. This is lead from the change in vapor pressure. The higher the vapor pressure is, the more the fuel accumulates on the wall of the intake flow passage. The vapor pressure is a partial pressure, the pressure inside the intake flow passage is, therefore, affected mainly by air." Therefore, the greater the air suction flow rate is, the greater the increase in the amount of liquid film in the intake pipe. According to the disclosure in this Japanese Patent Publication, the equilibrium intake surface fuel relates to the absolute pressure in the intake manifold, and is closely related to the engine load. Therefore, when the absolute pressure in intake manifold is represented on the abscissa and the equilibrium intake surface fuel is represented on the ordinate, a family of curves, depending on the rotating speed of engine is generated. As an embodiment, the absolute pressure in the intake manifold and the rotating speed of the engine are used in calculating the current equilibrium intake surface fuel and as the parameters for the current intake surface time constant.

Japanese Patent Publication No. 3-59255 (1991) is similar to Japanese Patent Publication No. 62-48053 (1987). In JP 3-59255, a wall surface fuel condensation and evaporation rates are determined based on engine operating parameters, including at least the pressure in the intake manifold. An increase or amount decrease in the amount of wall surface fuel during a given cycle period is calculated and accumulated based on the condensation and evaporation rates and the results are used to correct the wall surface fuel and, finally the basic fuel injection rate.

The wall surface fuel condensation and evaporation rates are functions of the pressure in the intake manifold, the temperature of engine water, the rotating speed of engine and the intake air flow velocity. The higher the pressure in intake manifold is, the greater the wall surface fuel condensation rate is. In other words, air flow rate increases, the larger the wall surface fuel condensation rate increases with increasing air flow rate.

According to the prior art described above, the fuel condensation rate is a function of (that is, proportional to) the suction pressure. (The condensation rate increases as the suction pressure approaches atmospheric pressure). Therefore, there is a disadvantage that when the intake pressure approaches atmospheric pressure, such as in low speed high load operation, a pulsation occurs in intake air flow, which finally decreases the accuracy in the fuel injection rate.

Further, according to the prior art described above, since the calculations for the fuel condensation rate and the fuel evaporating rate are performed by inputting two variables (intake manifold pressure and engine speed), the calculating load borne by a processing unit becomes large because of the memory area necessary to store condensation and evaporating rates in advance, the retrieving time for these rates is increased, and the matching work process increases because of the large number of variables to be stored in advance in connection with the above problem.

SUMMARY OF THE INVENTION

One object of the present invention is to prevent degradation in the accuracy of fuel injection rate control due to the effect of pulsation in the intake air flow rate.

Another object of the present invention is to simplify the calculation of the fuel injection rate.

A further object of the present invention is to decrease the processes for matching work by decreasing the kinds of constants for calculating the fuel injection rate to be set in advance.

These and other objects and advantages are achieved by the fuel control method according to the invention which comprises the steps of:

(a) determining the engine intake air flow rate;

(b) determining the engine rotating speed:

(c) determining a condensation rate (that is, the rate at which fuel condenses on the air intake passage of the internal combustion engine) using the air flow rate;

(d) determining an evaporation rate (rate of fuel evaporated from the fuel attached on the intake passage and entered into the cylinder of the internal combustion engine) using the air flow rate;

(e) determining an estimated fuel condensation amount (the amount of fuel contained in a film on the air suction passage) based on the condensation and evaporation rates; and (f) determining a required fuel flow rate using the air flow rate, the engine speed, the evaporation and condensation rates, and the estimated fuel condensation amount.

The present invention is also provides a fuel control system for an internal combustion engine, with (a) a sensor for determining the engine intake air flow rate;

(b) a sensor for determining the engine rotating speed;

(c) a processor for determining a fuel condensation rate based on the intake air flow rate;

(d) a processor for determining a fuel evaporation rate, based on the air flow rate;

(e) a processor for determining an estimated fuel condensation amount based at least on the fuel condensation and evaporation rates; and (f) a process for determining a required fuel flow rate using the air flow rate, the engine speed, the estimated fuel condensation and evaporation amounts, and the estimated fuel condensation amounts.

According to the method and apparatus described above, the effect of pulsation is decreased because the fuel condensation rate is a function of intake air flow rate.

Further, since the fuel condensation rate and the fuel evaporation rate are based on the single variable of the intake air flow, the memory area in the system can be decreased, calculating load is decreased and matching work processes for production is also decreased.

Other objects, advantages and novel features of the present invention will become apparent from the following detailed description of the invention when considered in conjunction with the accompanying drawings.

BRIEF DESCRIPTION OF THE DRAWINGS

FIG. 3 is a block diagram showing an embodiment of a control according to the present invention:

DETAILED DESCRIPTION OF THE PREFERRED EMBODIMENTS

Figure 1:
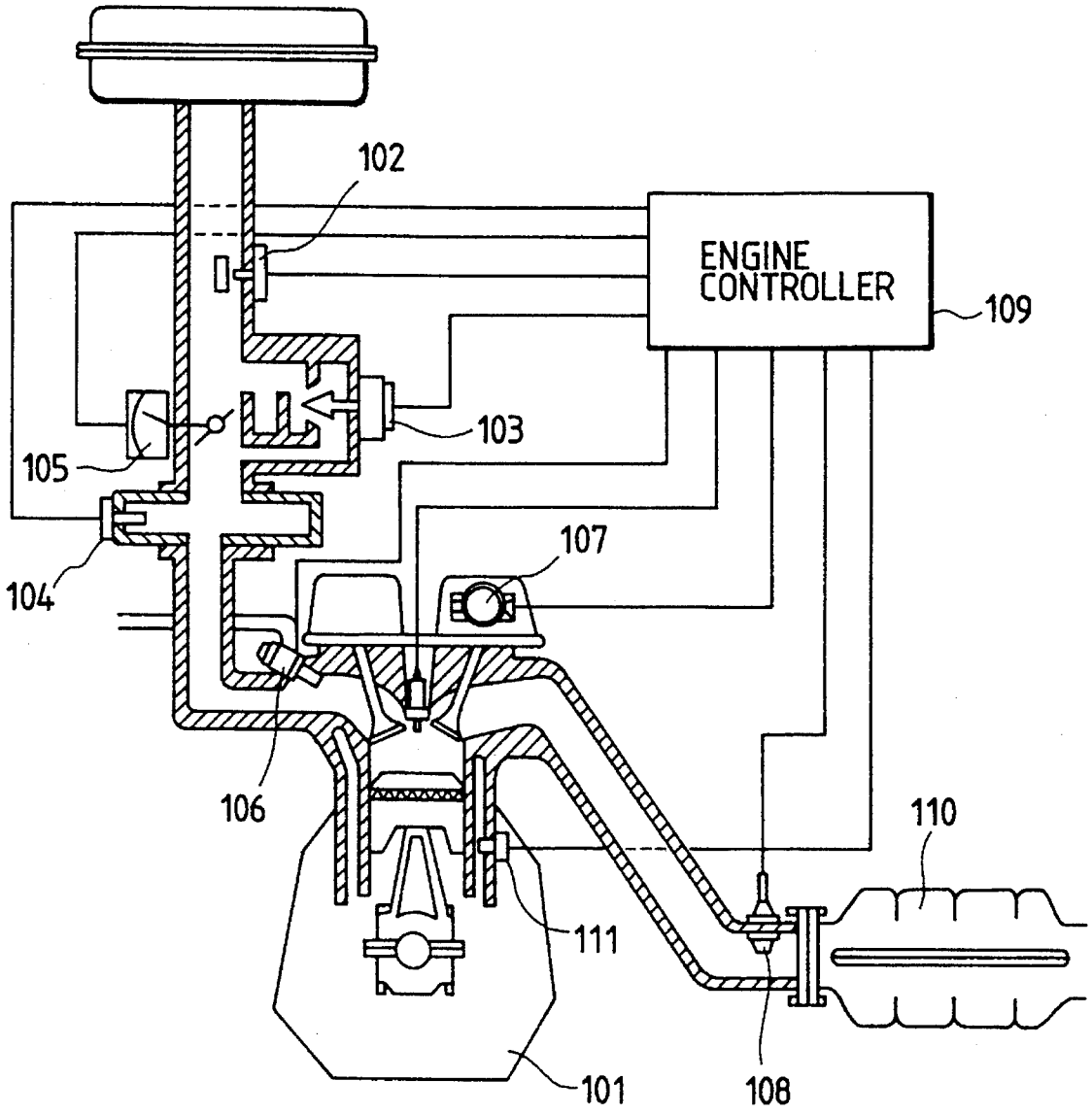
FIG. 1 is a view showing an internal combustion engine fuel control system according to the present invention.

An embodiment according to the present invention will be described below, referring to the accompanying drawings. FIG. 1 is schematic depiction of an internal combustion engine using a system according to the present invention. The internal combustion engine 101 comprises a thermal type air flow meter 102 for measuring the mass flow rate of intake air flow, a throttle valve opening sensor 105 for outputting the opening degree of a throttle valve provided in a intake manifold in order to control the air flow rate to be sucked into the internal combustion engine, a crank angle sensor 107 for detecting a rotating speed of the internal combustion engine, an intake manifold pressure sensor 104 for detecting pressure fluctuation in the intake manifold, a control valve 103 for controlling the mass air flow entering into the internal combustion engine through a by-pass passage, a fuel injector 106 for supplying fuel to the internal combustion engine, a three way catalyst 110 for purifying exhaust gas by means of oxidation and reduction, an oxygen density sensor 108 placed upstream of the three way catalyst 110, for detecting the oxygen density in exhaust gas, a water temperature sensor 111 for detecting the temperature of cooling water of the internal combustion engine 101, and an internal combustion engine control unit 109 for detecting the operating state of the internal combustion engine using the signals from the various sensors described above, calculating the fuel flow rate required by the internal combustion engine according to a procedure given in advance using these signals, and driving actuators such as the fuel injection valve described above. In this embodiment, the oxygen density sensor 108 outputs binary value indicating whether the oxygen density is in the leaner side or the richer side compared to the theoretical (stoichiometric) air/fuel ratio. Further, although the internal combustion engine control unit 109 in this embodiment receives the signals for intake air flow rate from the thermal type air flow mater 102, from the throttle valve opening sensor 105 and from the intake manifold pressure sensor 104, it is sufficient for an actual unit to receive at least one of such signals from the sensors.

Figure 2:
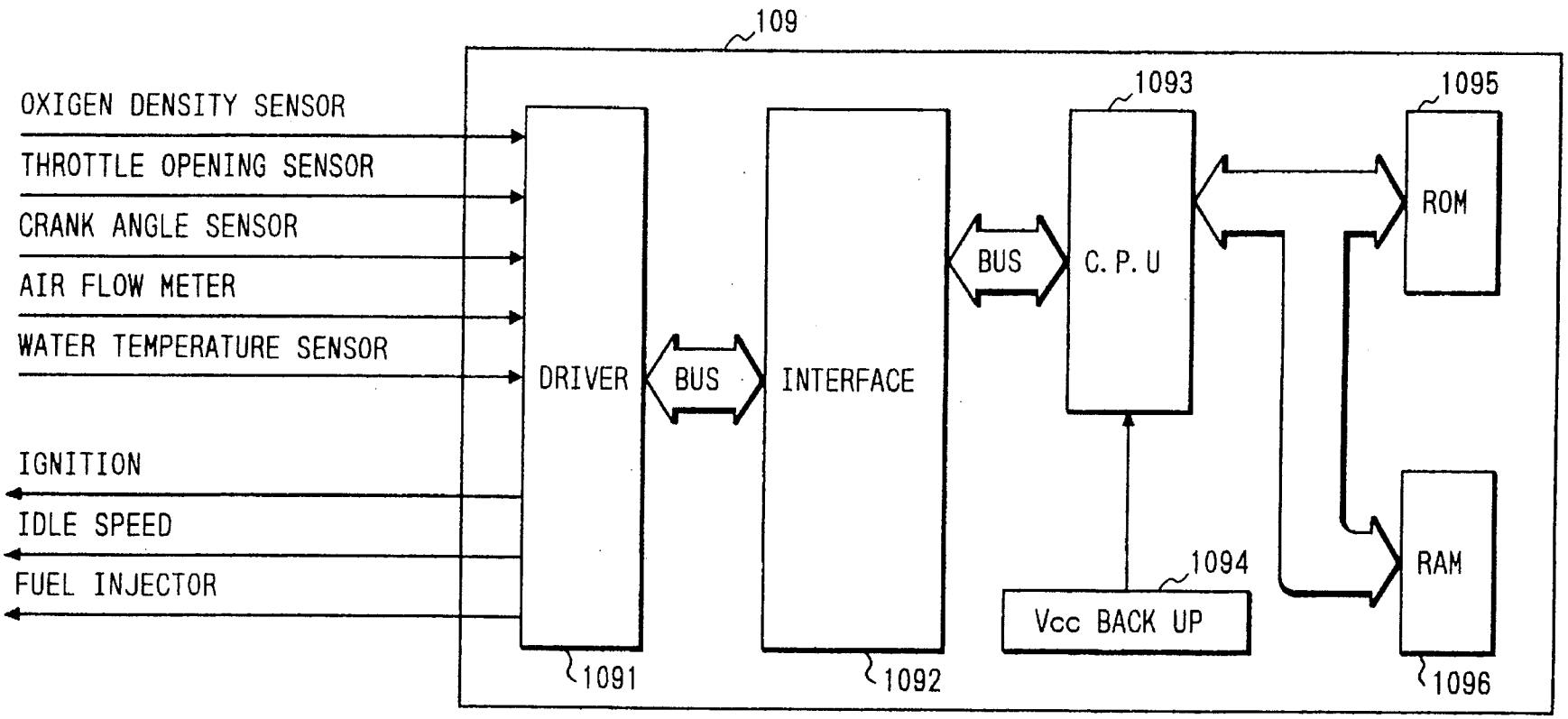
FIG. 2 is a block diagram showing the processing configuration of an embodiment of an internal combustion engine control unit according to the present invention.

FIG. 2 shows a block diagram of the internal combustion engine control unit 109, which comprises a driver circuit 1091 for receiving the signals from the various sensors shown in FIG. 1 and converting them to a voltage level capable of driving the actuators, an input/output circuit 1092 for converting analog signals to digital signals for digital processing, a micro-computer 1093 or a calculating circuit having the corresponding function for performing digital processing, memories (a non-volatile ROM 1095 and a volatile RAM 1096) for storing the constants, variables and program used in the calculating circuit 1093, and a back-up voltage circuit 1094 for holding the contents of the volatile RAM 1096. Although a digital processing unit is used in this embodiment, an analog processing unit may be used. In the example shown in the figure, the input signals are those from the oxygen density sensor 108, the throttle valve opening sensor 105, the crank angle sensor 107, the thermal type air flow sensor 102 and the water temperature sensor 111. (The signal from the pressure sensor 104 may be used instead of the signal from the thermal type air flow meter 102.) The output signals are an ignition signal, an idling speed control signal and a fuel injection valve driving signal.

FIG. 3 shows an embodiment of a control logic arrangement according to the present invention, the control unit 109 in the internal combustion engine according to the present invention receives a signal 303 from the crank angle sensor 107 indicating the rotation speed of the internal combustion engine, a signal 301 from the thermal type air flow meter 102 indicating an intake air flow rate, a water temperature signal 304 from the water temperature sensor 111, and a signal 302 from the oxygen density sensor 108 indicating exhaust gas oxygen density.

The fuel condensation and evaporation rates are calculated by the condensation rate calculating unit 307 and evaporation rate calculating unit 308 based on the internal combustion engine water temperature signal 304 and the intake air flow rate signal 301 described above. The fuel liquid film compensation calculating unit 306 calculates the amount of fuel contained in a film inside the intake manifold using the fuel condensation and evaporation rates inside the intake manifold calculated by the calculating unit 307 and 308. The internal combustion engine demand fuel flow rate calculating unit 305 calculates a demand fuel flow rate for the internal combustion engine using the intake air flow rate signal 301, the internal combustion engine rotating speed signal 303, the fuel condensation rate and the fuel evaporation rate inside intake manifold, and the fuel liquid film amount calculated by the fuel liquid film compensation calculating unit. The air/fuel ratio correcting unit 309 corrects the fuel flow rate calculated by the internal combustion engine demand fuel flow rate calculating means 305. The correction may be performed by means of air/fuel ratio feedback using the exhaust gas oxygen density signal 302, by using the water temperature signal 304, by using the demand for increasing output power of the internal combustion engine. Such control techniques are very well known. The fuel flow rate signal corrected by the air/fuel correcting unit 309 is transmitted to the fuel injector 106 for supplying fuel to the internal combustion engine.

Figure 4A:
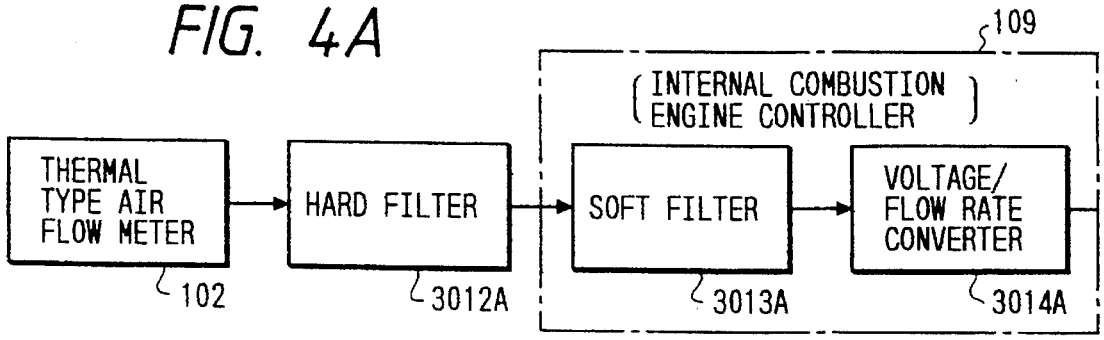
FIG. 4A to FIG. 4C show embodiments of the various kinds of air flow detecting arrangements according to the present invention.
Figure 4B:
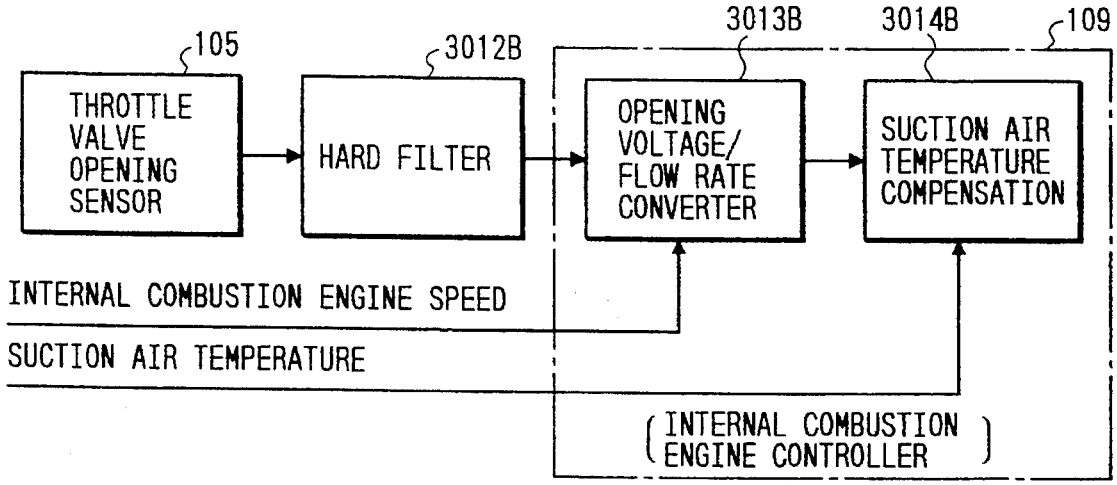
Figure 4C:
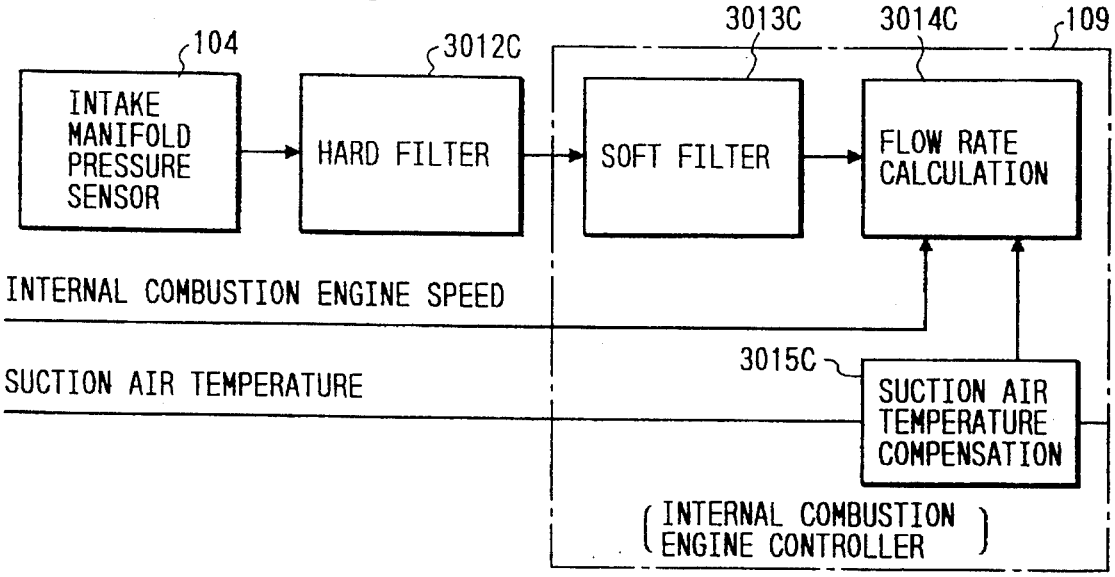

FIG. 4A to FIG. 4C show embodiments of the various kinds of the air flow detecting units in FIG. 3, utilizing respectively a thermal type air flow meter 102, a throttle valve opening sensor 105 and an intake manifold pressure sensor 104 are used. In FIG. 4A, the electric signal from the thermal type air flow meter 102 is input to the calculating unit in the internal combustion engine control unit 109 through a hard filter 3012A composed of electric elements. The suction pressure pulsation component is removed by a filter 3013A, and the signal is then converted from voltage to current in block 3014A to calculate the intake air flow rate. In FIG. 4B, the throttle valve opening angle signal output from the throttle valve opening sensor 105 is input to the calculating unit in the internal combustion engine control unit 109 through a hard filter 3012B composed of electric elements, in the same manner as in FIG. 4A. In the internal combustion engine control unit, the signal is converted from opening degree voltage to flow rate in block 3013B, and then compensated against suction air temperature in block 3014B using the air temperature measured by the thermal type air flow sensor for flow rate calculation or the suction air temperature measured by a suction air temperature sensor to calculate the suction air flow rate.

In the embodiment of FIG. 4C, the electric pressure signal output from the intake manifold pressure sensor 104 is once again input to the calculating unit in the internal combustion engine control unit 109 through a hard filter 3012C composed of electric elements. The suction pressure pulsation component is removed by a filter 3013C, and the signal is then input to a block 3014C to calculate the suction air flow rate using the suction air compensation coefficient calculated by a suction air temperature compensation block 3015C and the rotating speed of the internal combustion engine.

The behavior of fuel inside the intake manifold of the internal combustion engine will be described below. The model equation is shown in Equation 1.*a* and 1.*b:*

$$\frac{d}{dt} Mf = X \cdot Gf - \frac{1}{\tau} Mf \qquad \text{(Equation 1.a)}$$

$$Gfe = (1 - X)Gf + \frac{1}{\tau} Mf \qquad \text{(Equation 1.b)}$$

Mf: amount of equilibrium liquid film

Gf: fuel injection rate of fuel injection means

Gfe: fuel flow rate entering to cylinder

X: fuel attaching rate $1/\tau$: fuel evaporating rate

In this model, the fuel inside the intake manifold is divided into three components: the equilibrium liquid film Mf attaching to the intake manifold, the fuel injection rate Gf injected from the fuel injecting means in the internal combustion engine, and the fuel flow rate Gfe entering the cylinders of the internal combustion engine. Defining the ratio of fuel condensation (which adds to the equilibrium liquid film) to the fuel injection rate of the fuel injectors as the fuel condensation rate X, and the rate at which fuel evaporates from the liquid film as the fuel evaporating rate $1/\tau$, The relation described in Equations 1.*a* and 1.*b* can be obtained. Therefore, considering that the fuel flowing from the fuel injectors is attached to and evaporated from the intake manifold, the correction equation for correcting the fuel flow rate with the air/ fuel ratio becomes as Equation 2.*a* and 2.*b:*

$$Gf = \frac{Gfe - \frac{1}{\tau} Mf}{1 - X} \qquad \text{(Equation 2.a)}$$

$$Gfe = \frac{Qa}{A/F} \qquad \text{(Equation 2.b)}$$

$$Mf = \Delta t \cdot X \cdot Gf - (1 - 1/\tau \cdot \Delta t) Mf_{-1}|_{1am\Delta t \to 0} \qquad (5)$$

Qa: suction air flow rate

A/F: target air/fuel ratio $\Delta t$: time increment

In a case where the internal combustion engine control unit is a micro-computer performing digital calculations, $\Delta t$ becomes its calculating cycle. It is preferable that the $\Delta t$ is as small as possible. In a case where the internal combustion engine control unit performs analog calculation, it is needless to say that the differential equations in Equation 1 can be directly calculated regardless of $\Delta t$.

Figure 5:
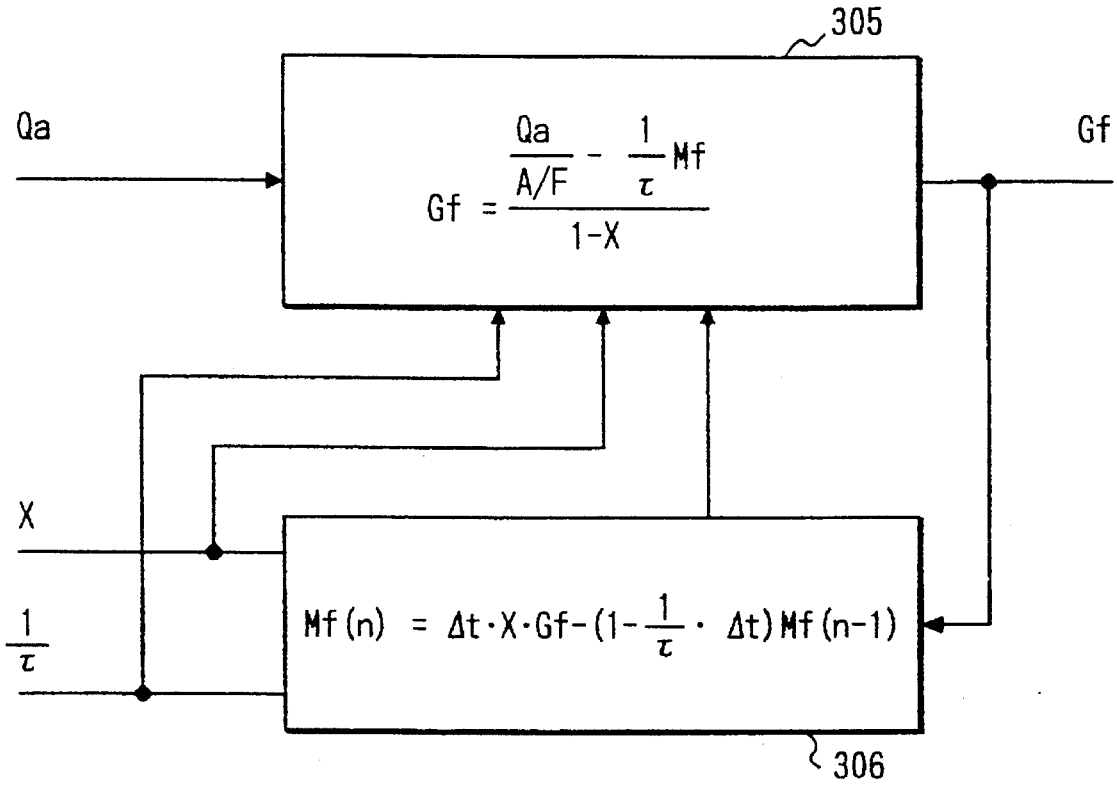
FIG. 5 shows the internal combustion engine required fuel flow rate calculation and the fuel liquid film compensation calculation in the embodiment of the control block diagram according to the present invention.

FIG. 5 shows the control means in FIG. 3 to which Equations 1.*a* and 1.*b* and 2.*a* and 2.*b* are applied. The fuel liquid film compensation calculating unit 306 receives the fuel condensation rate X, (from unit 307), the fuel evaporation rate $1/\tau$ (from unit 308) and the fuel injection rate Gf, and digitally calculates the amount of equilibrium liquid film Mf. The internal combustion engine demand fuel flow rate calculating unit 305 receives the suction air flow rate Qa, the fuel condensation rate X, the fuel evaporating rate $1/\tau$ and the amount of equilibrium liquid film Mf calculated by the fuel liquid film compensation calculating means 306 and calculates the fuel flow rate Gf in which the amount of fuel liquid film is considered.

Figure 6:
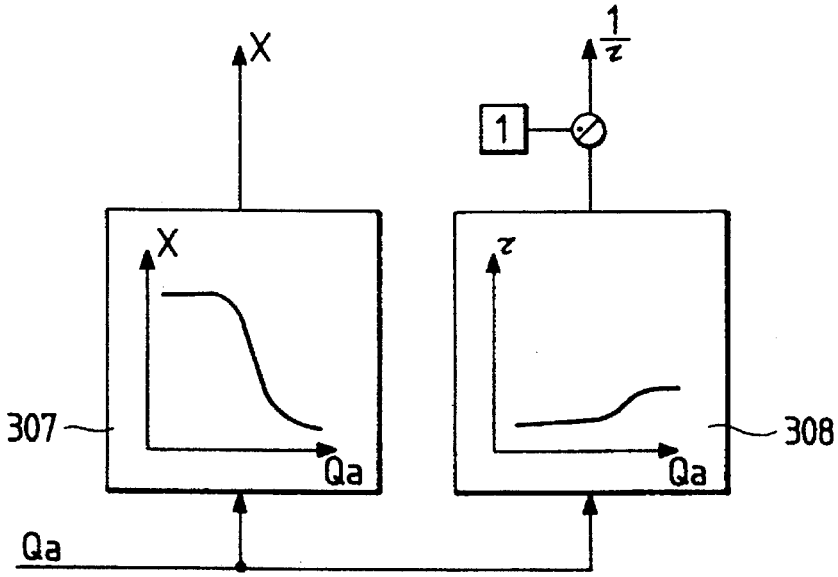
FIG. 6 shows an example of the fuel condensation rate and evaporation rate calculation in the embodiment of the control block diagram according to the present invention.

FIG. 6 shows examples of the fuel condensation rate calculating unit 307 and the fuel evaporating rate calculating unit 308. The fuel condensation rate calculating means 307 and the fuel evaporating rate calculating means 308 both receive the intake air flow rate Qa. Both calculating units 307 and 308 have stored therein one-dimensional look up tables which are used to retrieve the fuel attaching rate X and the fuel evaporating rate $1/\tau$ based on the intake air flow rate. In this embodiment, since the evaporating rate used in the internal combustion engine demand fuel flow rate calculating unit 305 and the fuel liquid film compensation calculating unit 306 is stored as the reciprocal evaporating rate, the logic installed is constructed accordingly. The fuel condensation rate calculating unit 307 and the fuel evaporation rate calculating unit 308 in FIG. 3 receive the internal combustion engine water temperature signal to perform a water temperature correction (not shown in FIG. 6). As a practical example of the water temperature correction, a water temperature correction coefficient is retrieved from a one-dimensional look up table base on the internal combustion engine water temperature and multiply it by the fuel condensation rate X and the fuel evaporating rate $1/\tau$. Although the retrieval in this embodiment is performed by use of tables, it is needless to say that approximation equations may be used to calculate them.

Figure 7:
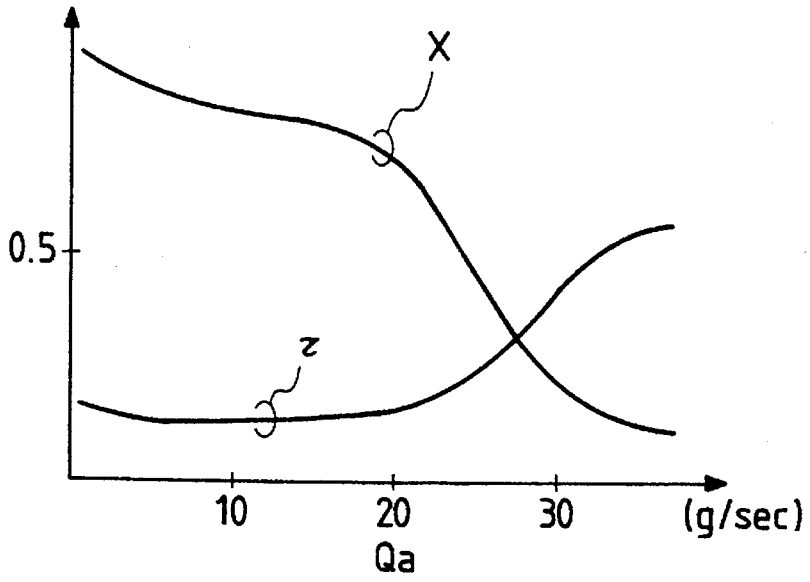
FIG. 7 is a graph showing the relationship between the fuel condensation and evaporating rates and the intake air flow rate in an embodiment according to the present invention.

FIG. 7 shows the relationships between the suction air flow rate Qa on the one hand, and the fuel condensation rate X and fuel evaporating rate $1/\tau$ on the other. As can be seen from the figure, both the fuel condensation rate X and the fuel evaporating rate $1/\tau$ have a linear relationship with the suction air flow rate Qa. The fuel condensation rate X is large at a low suction air flow rate, and decreases as the suction air flow rate increases. That is, the fuel attaching rate is in inverse proportion to the suction air flow rate.

Equation 3 shows an example of the transfer function using Laplace operator obtained from rewriting the relation in Equation 1.*b*. Fuel correction in this embodiment is performed by of filtering.

$$Gfe(s) = \frac{1 + (1 - X) \cdot \tau \cdot s}{1 + \tau \cdot s} \cdot Gf(s) \qquad \text{(Equation 3)}$$

Figure 8:
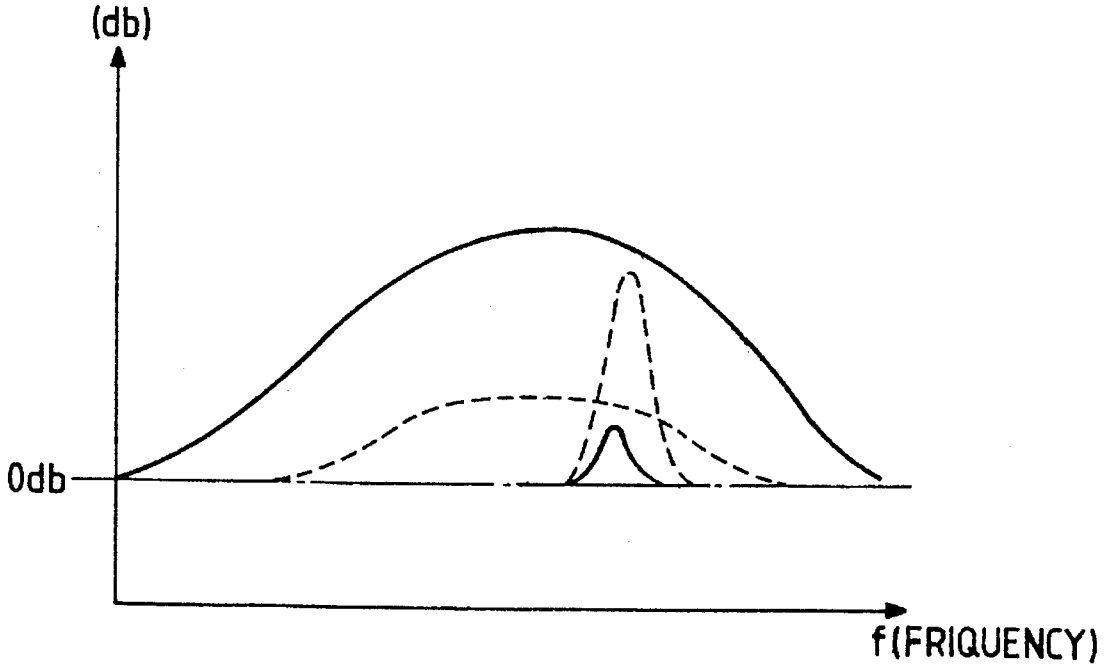
FIG. 8 is a graph showing the relationship between the gain of transfer function for fuel liquid correction and the power spectrum of pulsation in the intake mass air flow and pressure in an embodiment according to the present invention.

FIG. 8 is a Bode diagram showing the gain of the transfer function in Equation 3. When the intake air flow rate Qa is low, the gain becomes large (since the fuel condensation rate X is large, while the pulsation in suction pressure is small (since the intake pressure is higher than the atmospheric pressure). Therefore, the pulsating power spectrum in the Bode diagram is small. On the other hand, when the intake air flow rate is large, the gain becomes small (since the fuel condensation rate X is small), while the pulsating power spectrum in the Bode diagram is large, (since the intake pressure) is near the atmospheric pressure.

Figure 9:
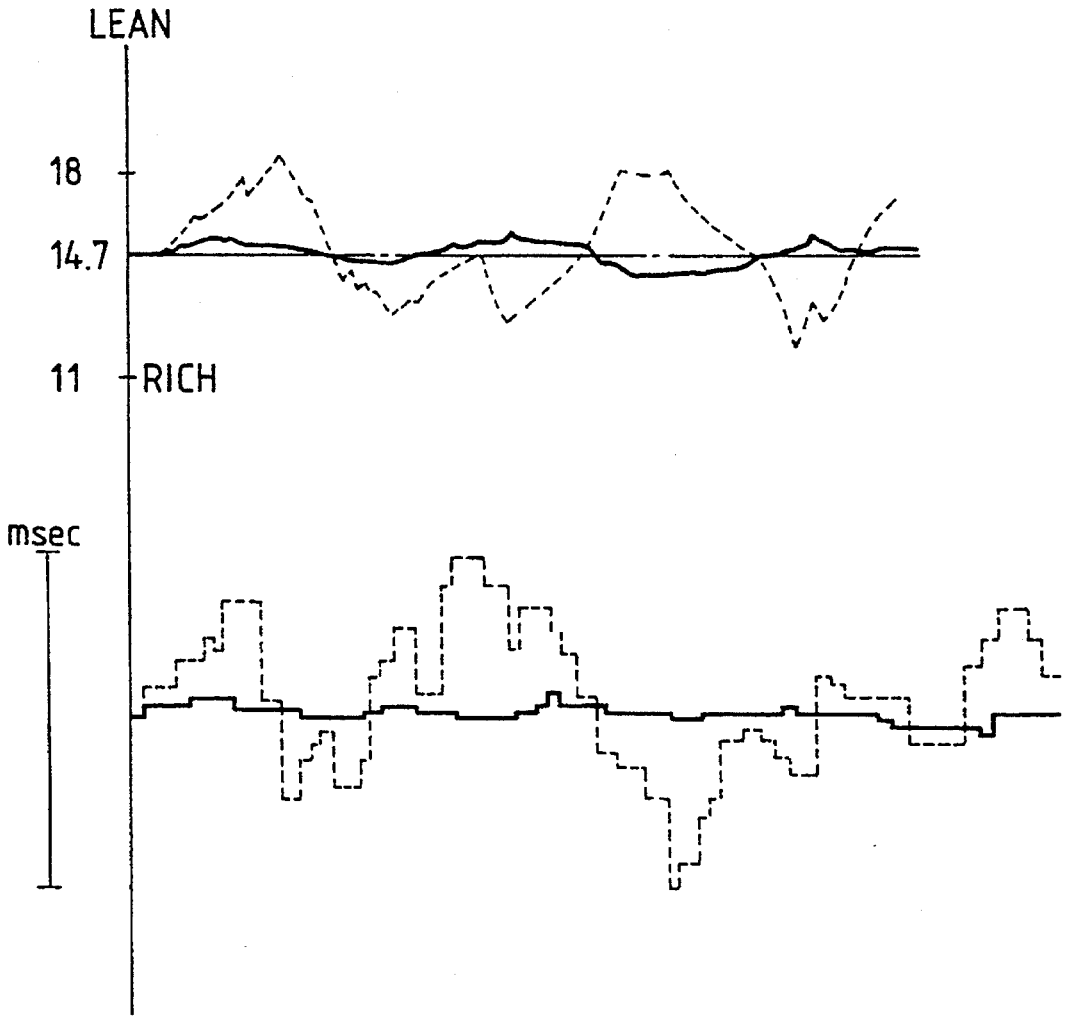
FIG. 9 is a chart showing the fluctuation of air/fuel ratio and the fuel injection width in an embodiment according to the present invention.

FIG. 9 shows the relationships between the characteristic of the fuel condensation rate and the fluctuation in air/fuel ratio, and between the characteristic of the fuel condensation rate and the width of fuel injection during normal operation of the internal combustion engine. The indication "X of negative characteristic" in the figure means "the fuel condensation rate has the relationship shown in FIG. 7", and the indication "X of positive characteristic" means "the fuel condensation rate has the conventional relationship (the fuel condensation rate is in direct proportion to the intake air flow rate)". In the curve marked X of positive characteristic, when the suction air flow rate increases, the gain of the transfer function in Equation 3 increases. In addition, since the pulsation of the intake pressure increases, the air/fuel ratio becomes unstable as shown in the figure. The lower portion of FIG. 9 shows the width of fuel injection. In a case where the fuel condensation rate has a positive characteristic, the width of fuel injection is not stable since pulsation of the intake pressure increases.

On the other hand, in X of negative characteristic, when the air flow rate increases, the gain decreases and the air/fuel ratio becomes stable.

Therefore, the width of fuel injection becomes stable.

Figure 10:
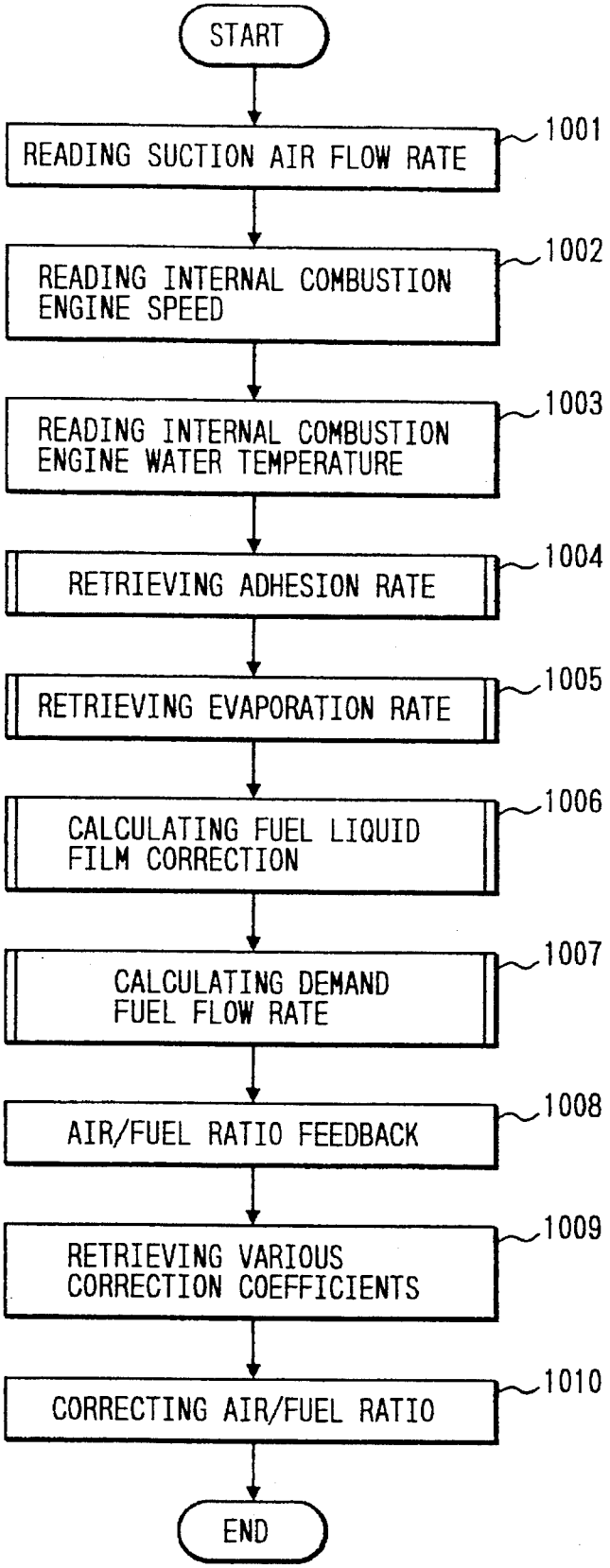
FIG. 10 is a general flow chart of entire control blocks in an embodiment according to the present invention.

FIG. 10 is a general flow chart of control blocks of the internal combustion engine control unit shown in FIG. 3. In steps 1001, 1002 and 1003, suction air flow rate Qa, engine rotating speed N and engine water temperature Tw are read respectively. A fuel condensation rate X is read in step 1004, and a fuel evaporating rate $1/\tau$ is read in step 1005. In steps 1006 and 1007, a amount of fuel contained in the equilibrium liquid film Mf is calculated using the suction air flow rate Qa, engine rotating speed N, engine water temperature Tw, the fuel condensation rate X and the fuel evaporation rate $1/\tau$, and a demand fuel flow rate Gf is calculated. These calculations are performed using Equations 1.*a* and .*b* and 2.*a* and .*b*. In steps 1008, 1009 and 1010, the air/fuel correction is performed. In step 1008, the air/fuel ratio is controlled to follow the theoretical air/fuel ratio based on the output signal from the oxygen concentration sensor 108 provided on the exhaust pipe. (Such control is generally performed during a normal operation of internal combustion engine). The air/fuel correction in step 1009 is performed by reading a correction coefficient for air/fuel ratio, at power increasing or at starting. The correction coefficients obtained in step 1008 and 1009 are multiplied by the calculated demand fuel flow rate in step 1010.

Figure 11:
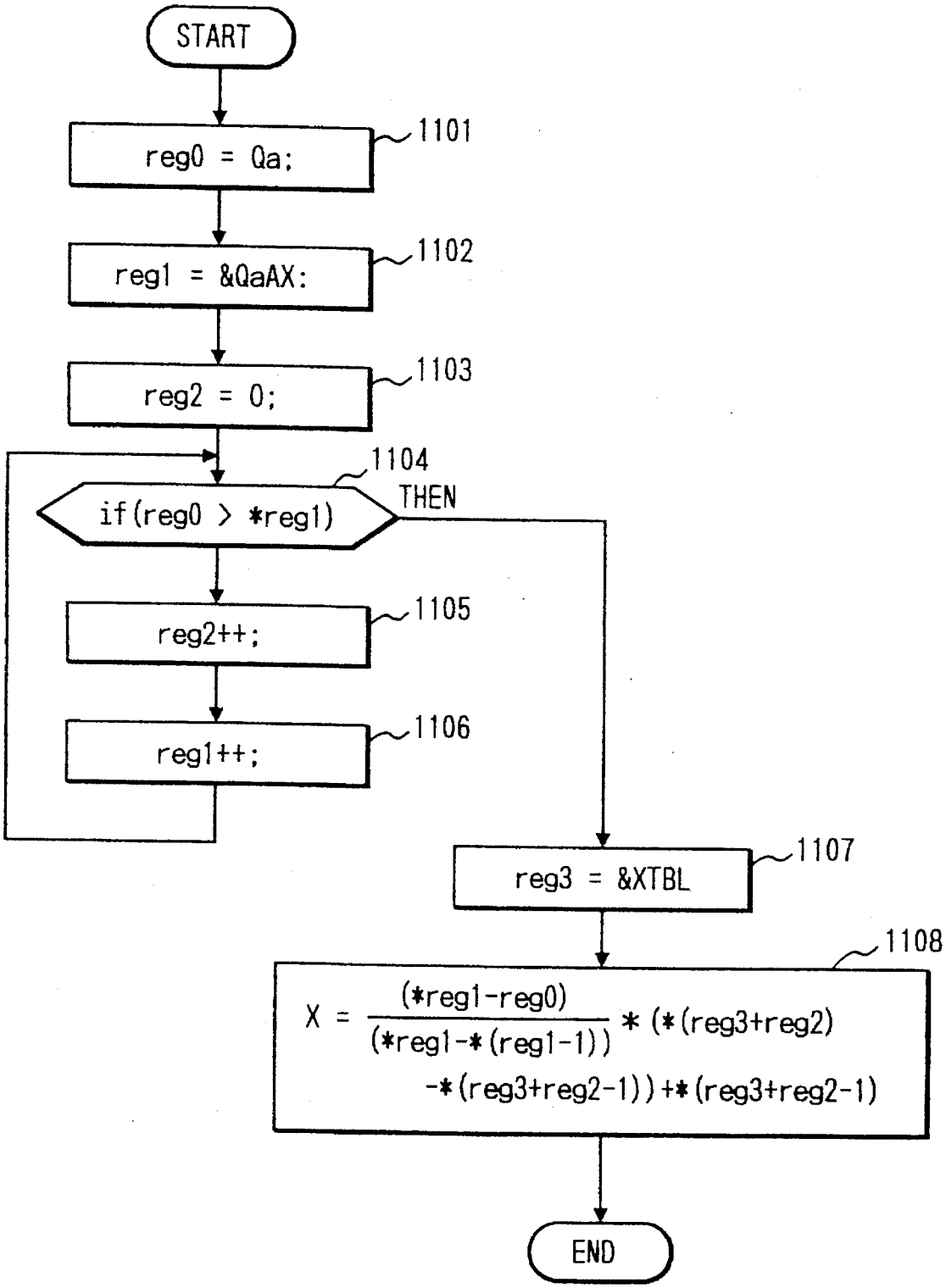
FIG. 11 is a detailed flow chart of the fuel condensation evaporation rate retrieval in an embodiment according to the present invention.

FIG. 11 is a detailed flow chart of the fuel condensation rate calculating unit 307 and the fuel evaporating rate calculating unit 308 in FIG. 3 above. In steps 1101 and 1102, an engine intake air flow rate and an address of a table for reading an air flow rate axis top address are substituted for variables. In step 1103, a suction air flow rate axis pointer is cleared. In steps 1104, 1105 and 1106, the address in the table for reading air flow rate and the intake air flow rate pointer are increased incrementally until the internal combustion engine intake air flow rate exceeds an air flow rate value read from a table. If it does, a fuel condensation rate table top address is substituted for a variable in step 1107, and a fuel condensation rate is calculated by interpolation using the table for reading air flow rate axis value and the suction air flow rate axis pointer.

Figure 12:
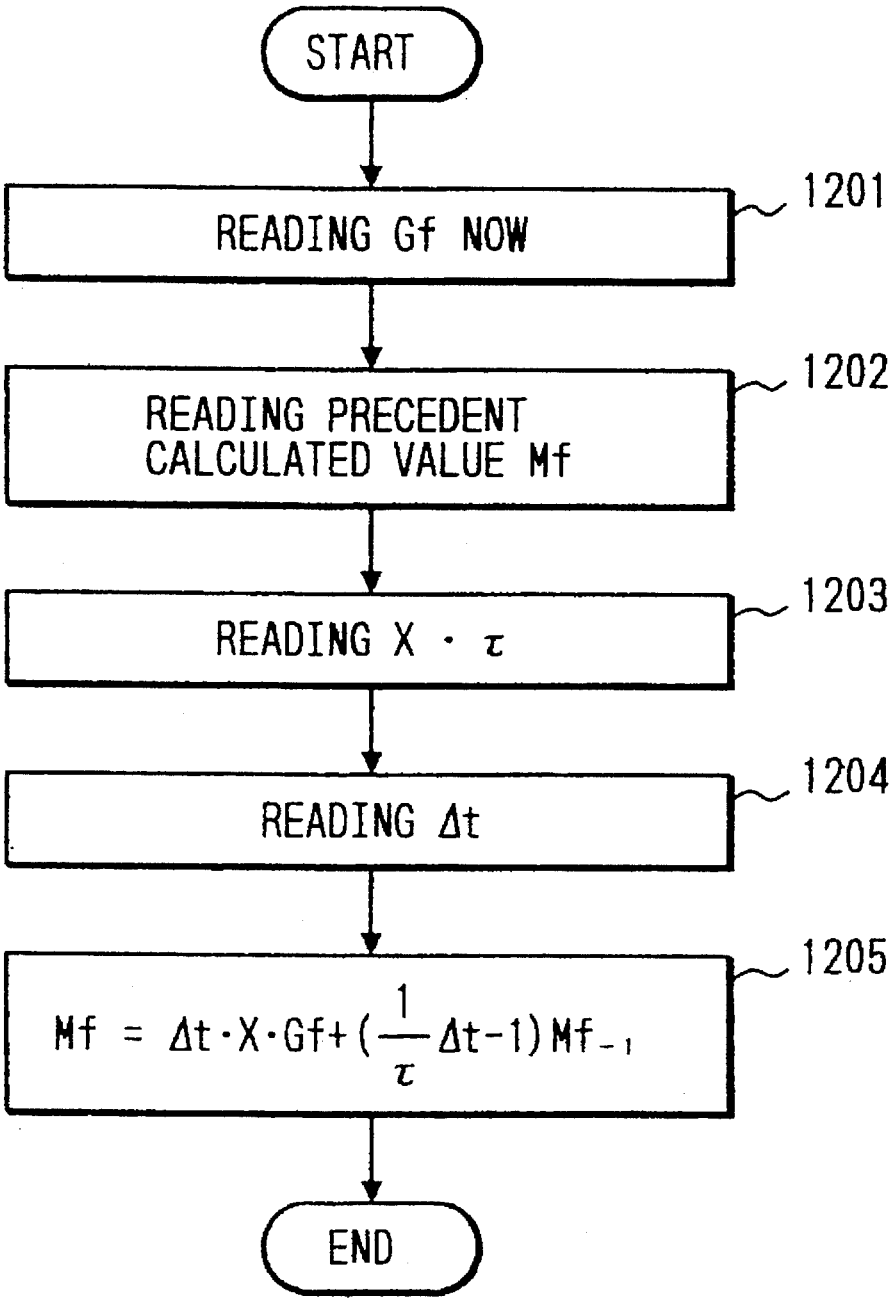
FIG. 12 is a general flow chart of the fuel liquid film compensation calculating means in an embodiment according to the present invention.

FIG. 12 is a general flow chart of the fuel liquid film compensation calculating unit 306 in FIG. 3. In steps 1201, 1202 and 1203, a current fuel injection rate, the amount of the equilibrium liquid film Mf, the fuel condensation rate X and the fuel evaporating rate $1/\tau$ (calculated previously) are read. In step 1204, the calculating cycle executing this flow-chart is read. In step 1205, the amount of equilibrium liquid film in Equation 2.*a* is calculated using the above read variables.

Figure 13:
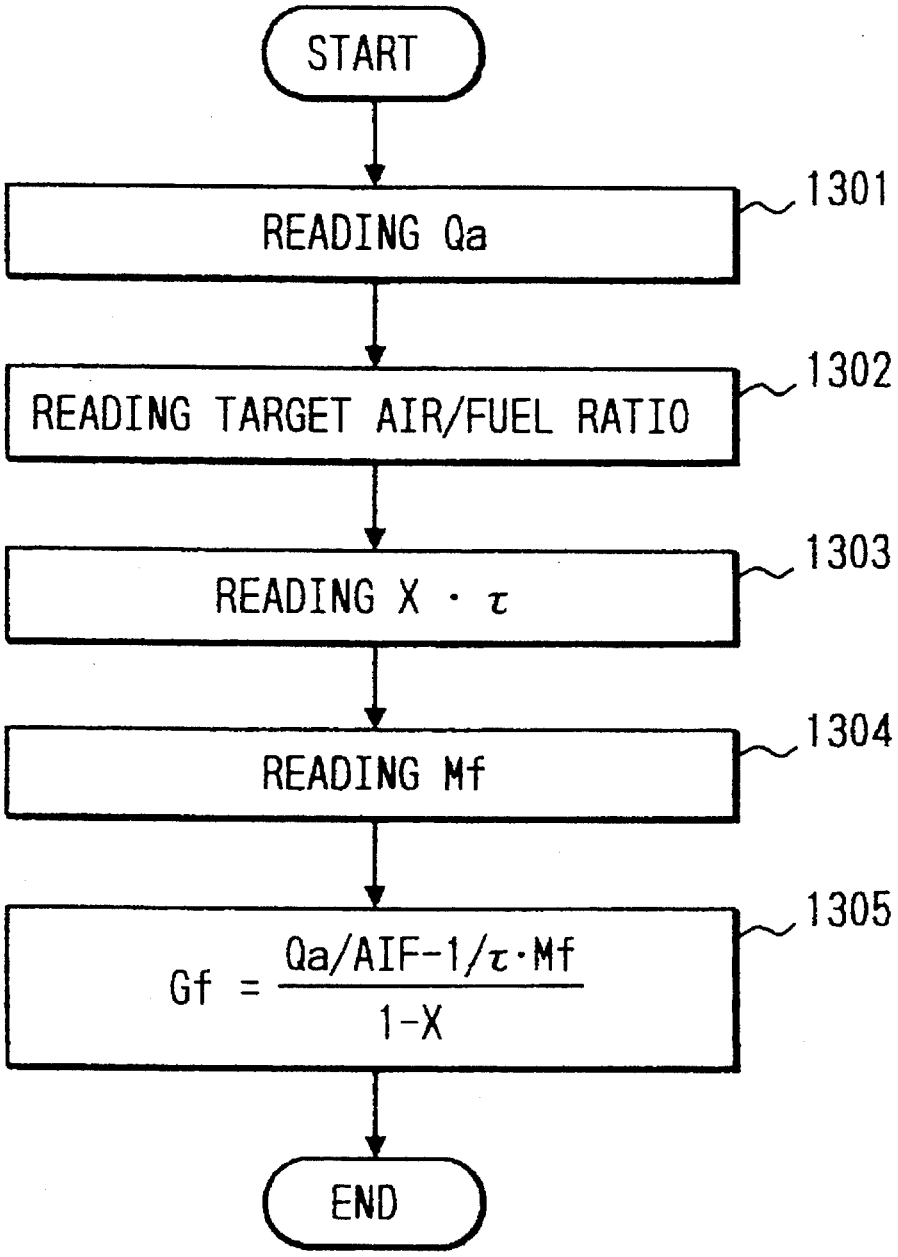
FIG. 13 is a general flow chart showing an embodiment of internal combustion engine demand fuel flow rate calculating means according to the present invention.

FIG. 13 is a general flow chart of the internal combustion engine demand fuel flow rate calculating means 305 in FIG. 3. In steps 1301, 1302, 1303 and 1304, the engine intake air flow rate, the target air/fuel ratio, the fuel condensation rate, the fuel evaporating rate and the amount of equilibrium liquid film (calculated as shown in the flow chart in FIG. 12) are read. In step 1305, the demand fuel flow rate in Equation 2 is calculated using the above read variables.

According to the present invention, as described above, the effect of pulsation in the intake pressure can be decreased since the fuel condensation rate is determined as a function of intake air flow rate.

Further, since the fuel condensation rate and the fuel evaporation rate are read base on the intake air flow rate, the memory capacity can be decreased and the fuel control system can be simplified. Since the calculating load is decreased, new control items may be added to the fuel control system. Furthermore, since the number of constants to be set in advance is decreased, the amount of base testing to establish control is decreased and the matching work processes can be decreased. Therefore, the cost of the system itself can be decreased.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A fuel control method for an internal combustion engine, which comprises the steps of:

(a) measuring the air flow rate sucked into the internal combustion engine;

(b) measuring the rotating speed of the internal combustion engine;

(c) determining a fuel condensation rate based on the air flow rate;

(d) determining a fuel evaporation rate based on the air flow rate;

(e) determining an estimated fuel condensation amount based on the fuel condensation rate and fuel evaporation rate;

(f) determining a required fuel flow rate using the intake air flow rate, the rotating speed, the condensation rate, the evaporation rate and the estimated fuel condensation amount; and (g) adjusting fuel input to said internal combustion engine in response to said required fuel flow rate.

2. A fuel control method for an internal combustion engine according to claim 1, wherein:

said fuel condensation rate has a characteristic which decreases as the air flow rate increases.

3. A fuel control method for an internal combustion engine according to claim 1, wherein:

said required fuel flow rate is further corrected by a water temperature correction and a feed-back correction using an oxygen sensor.

4. A fuel control system for an internal combustion engine which comprises:

(a) a detector for measuring an intake air flow rate into the internal combustion engine;

(b) a detector for measuring rotating speed of the internal combustion engine;

(c) a processor for determining a fuel condensation rate using the intake air flow rate;

(d) a processor for determining a fuel evaporation rate using the intake air flow rate;

(e) a processor for determining an estimated fuel condensation amount based at least on the fuel condensation rate and the fuel evaporation rate; and (f) a processor for determining a required fuel flow rate using the intake air flow rate, the rotating speed, the condensation rate, the evaporation rate arid the estimated fuel condensation amount.

5. A fuel control system for an internal combustion engine according to claim 4, wherein:

said processor for determining a fuel condensation rate comprises a one-dimensional look up table, and means for reading a fuel condensation rate from said table based on the intake air flow rate into the internal combustion engine.

6. A fuel control system for an internal combustion engine according to claim 4, wherein:

said processor for determining a fuel evaporation rate comprises a one-dimensional look up table, and means for reading a fuel evaporation rate from said table based on the intake air flow rate into the internal combustion engine.

7. A fuel control system for an internal combustion engine according to claim 4, wherein:

the fuel condensation rate has a characteristic which decreases as the air flow rate increases.

8. A fuel control system for an internal combustion engine according to claim 4, wherein:

the detector for determining the intake air flow rate into the internal combustion engine comprises a thermal type air flow meter.

9. A fuel control system for an internal combustion engine according to claim 4, wherein the detector for determining the intake air flow rate into the internal combustion engine comprises:

a sensor for detecting extent of opening of a throttle valve provided in an air flow passage of the internal combustion engine;

a sensor for detecting temperature of intake air sucked into the internal combustion engine; and a rotation sensor for detecting rotating speed of a power shaft of the internal combustion engine.

10. A fuel control system for an internal combustion engine according to claim 4, wherein the detector for determining the intake air flow rate into the internal combustion engine comprises:

a sensor for detecting pressure in an air flow passage of the internal combustion engine;

a sensor for detecting temperature of intake air sucked into the internal combustion engine; and a rotation sensor for detecting rotating speed of a power shaft of the internal combustion engine.

11. A fuel control method for an internal combustion engine, which comprises the steps of:

(a) measuring an air flow rate into the internal combustion engine;

(b) determining a fuel condensation rate based on the air flow rate;

(c) determining a fuel evaporation rate based on the air flow rate;

(d) determining an estimated fuel condensation amount based on the fuel condensation rate and fuel evaporation rate;

(e) determining a required fuel flow rate using the air flow rate, the fuel evaporation rate and the estimated fuel condensation amount; and (f) adjusting fuel input to said internal combustion engine in response to said required fuel flow rate.

12. A fuel control method according to claim 11, wherein said fuel condensation rate has a characteristic which decreases as the air flow rate increases.

13. A fuel control method according to claim 11, wherein said step of determining a required fuel flow rate comprises:

determining a fuel flow rate based on said air flow rate into the internal combustion engine; and performing a correction based on the fuel condensation rate, the fuel evaporation rate and the estimated fuel condensation amount.

14. A fuel control method according to claim 11, wherein said step of determining a fuel condensation rate comprises reading said fuel condensation rate from a look-up table based on said air flow rate.

15. A fuel control method according to claim 11, wherein said step of determining a fuel evaporation rate comprises reading said fuel evaporation rate from a one dimensional look-up table based on said air flow rate.

16. A fuel control system for an internal combustion engine which comprises:

(a) a detector for measuring an intake air flow rate in the internal combustion engine;

(b) a processor for determining a fuel condensation rate using the intake air flow rate;

(c) a processor for determining a fuel evaporation rate using the intake air flow rate;

(d) a processor for determining an estimated fuel condensation amount based at least on the fuel condensation rate and the fuel evaporation rate; and (e) a processor for determining a required fuel flow rate using the air flow rate, the rotating speed, the fuel evaporation rate and the estimated fuel condensation amount.

17. A fuel control system for an internal combustion engine according to claim 16, wherein said processor for determining a required fuel flow rate determines a fuel flow rate based on the air flow rate and performs a correction based on the condensation rate, the evaporation rate and the estimated fuel condensation amount.

18. A fuel control system according to claim 16, wherein said processor for determining a fuel condensation rate comprises a one-dimensional look up table, and means for reading a fuel condensation rate from said table based on tile air flow rate into the internal combustion engine.

19. A fuel control system according to claim 16, wherein said processor for determining a fuel evaporation rate comprises a one-dimensional look up table, and means for reading a fuel evaporation rate from said table based on the air flow rate into the internal combustion engine.

20. A fuel control system according to claim 16, wherein said fuel condensation rate has a characteristic which decreases as the air flow increases.

* * * * *